United States Patent [19]

Tesch

[11] 4,330,422

[45] May 18, 1982

[54] TREATING COMPOSITION CONTAINING WHITE OIL

[75] Inventor: Sheila A. Tesch, Saint Paul, Minn.

[73] Assignee: Minnesota Mining and Manufacturing Company, Saint Paul, Minn.

[21] Appl. No.: 764,569

[22] Filed: Feb. 1, 1977

[51] Int. Cl.[3] ..... C11D 3/22

[52] U.S. Cl. ..... 252/89.1; 252/162; 252/170; 252/305; 252/308; 252/312; 134/40

[58] Field of Search ..... 252/305, 308, 312, 89, 252/311, 162, 170, 89.1; 134/40

[56] References Cited

U.S. PATENT DOCUMENTS

| | | | |
|---|---|---|---|
| 3,370,014 | 2/1968 | Reich et al. | 252/305 X |
| 3,553,146 | 1/1971 | Butke et al. | 134/40 X |
| 3,626,559 | 12/1971 | Rossmann et al. | 134/40 |
| 3,795,623 | 3/1974 | Gagnon | 252/305 X |
| 3,929,492 | 12/1975 | Chapman et al. | 252/305 X |

OTHER PUBLICATIONS

Merck Index, 9th ed. 1976, p. 931.

"Atlas" Surface Active Agents, 1948 pp. 8, 15, 20, 21, 38, 39, Table I Relied on.

*Primary Examiner*—Mayer Weinblatt

*Attorney, Agent, or Firm*—Cruzan Alexander; Donald M. Sell; Richard Francis

[57] ABSTRACT

A surface treating composition especially suited for cleaning and treating stainless steel comprising an aqueous emulsion of white mineral oil. An aerosol composition is also provided by the addition of a suitable amount of liquified normally gaseous propellant material.

5 Claims, No Drawings

TREATING COMPOSITION CONTAINING WHITE OIL

FIELD OF THE INVENTION

This invention relates to novel surface treating compositions comprised of an aqueous emulsion of white mineral oil. In another aspect, the invention relates to self-pressurized surface treating compositions comprising aqueous emulsions of white oil. In yet another aspect the invention relates to a method of cleaning and treating metal surfaces with these novel compositions.

DESCRIPTION OF THE PRIOR ART

It has heretofore been generally known to employ oils in formulations as an aid to cleaning and maintaining the appearance of hard surfaces. Such formulations have been in various forms, including pastes, solutions, lotions, creams, and as emulsions. Some oils, however, are undesirable because they are either hazardous, slowly volatile or highly combustible or because they have an undesirable affect on the surface being treated. Some leave excessive residues on the surface being treated. For example unsaturated oils will polymerize once applied upon exposure to atmospheric oxygen and the resultant residue is not easily removed by conventional cleaning solutions. This result causes considerable residue build up upon subsequent applications and produces an unsightly difficult-to-remove film. Slowly volatile oils, which may be more combustible, impart only a temporary surface treatment.

BRIEF DESCRIPTION OF THE INVENTION

The present invention provides a novel surface treating composition which avoids the problems mentioned above yet which easily cleans the treated surface, leaving the cleaned surface with a uniform shiny appearance. The surface treating composition of the invention is an aqueous emulsion of white mineral oil. The aqueous emulsion may either be of the oil-in-water type or the water-in-oil type, the latter type being preferred. The emulsion is formed predominately of water and contains an amount of a suitable emulsifying surfactant to produce either of these types of emulsions, but not so much surfactant to leave a noticeable residue on the surface being treated. The composition of the present invention may be dispensed from an aerosol container and; in such case, it contains sufficient liquified normally gaseous aerosol propellant.

The surface treating composition of the invention is especially suited for use in cleaning and treating highly polished stainless steel surfaces such as are typically found in commercial kitchens and in many other industrial and home locations. The treating composition of the invention easily removes both water-soluble and oil-soluble residues from the surface being treated and leaves a thin film of white mineral oil on the treated surface. This thin film of white oil leaves the treated surface with much more aesthetic appearance, both visually and to the touch. Unlike certain oils found in other treating compositions, the white mineral oil of the present invention does not polymerize upon exposure to atmospheric oxygen and therefore it will not accumulate as a difficult-to-remove residue on the surface being treated. Additionally, it is not slowly volatile; therefore, it remains on the treated surface indefinitely.

DETAILED DESCRIPTION OF THE INVENTION

The treating composition of the invention preferably comprises from about 20% to about 50% by weight white mineral oil and sufficient emulsification surfactant to form an oil-in-water emulsion or a water-in-oil emulsion, with the balance being water.

White mineral oil is used to designate certain highly refined mineral oils which possess a high level of purity. White mineral oils are produced by treating petroleum oil to remove all unsaturated and aromatic hydrocarbons, including polynuclear hydrocarbons, resulting in an oil which is free of harmful ingredients, color, odor and taste. Such refining involves treatment of the oil with fuming sulfuric acid which removes the unsaturated and aromatic hydrocarbons and certain other impurities, followed by neutralization with alkali, extraction with solvents and finally, by a process of adsorption refining which eliminates traces of carbonaceous material not previously removed by acid refining. The common adsorbent materials are of mineral origin and include the various fullers earths such as bauxite, magnesite and bentonite in natural state or in acid-activated form. The resultant water-white oil meets FDA purity requirements, is non-drying and non-staining, not gummy or sticky, and will not support pathogenic bacteria and mold growth.

The white mineral oils preferred for use in the compositions of the present invention will have a Saybolt viscosity at 100° F. in the range of about 50 to about 380 Saybolt seconds. The oil is undesirably volatile at viscosities below about 50 for use in a treating composition. Such volatility can cause streaking as the composition is wiped on the surface being treated and its evaporation leaves the treated surface without a protective coating of oil in a very short period of time. Oils having a Saybolt viscosity over about 380 are too viscous to wipe evenly and leave the surface being treated with an uneven oily appearance.

Exemplary white mineral oils useful for preparing compositions according to the present invention include those shown in Table I below.

TABLE I

| Tradename | Specific Gravity at 60° F. | Saybolt Viscosity at 100° F. (Saybolt Seconds) |
|---|---|---|
| Kaydol | 0.880/0.895 | 345/355 |
| Gloria | 0.875/0.885 | 200/210 |
| Protol | 0.870/0.880 | 180/190 |
| Ervol | 0.860/0.870 | 125/135 |
| Blandol | 0.845/0.860 | 80/90 |
| Carnation | 0.835/0.845 | 65/75 |
| Klearol | 0.828/0.838 | 50/60 |

The surfactant employed in the practice of the invention may be any one of many known surfactants used to obtain oil-in-water emulsions or water-in-oil emulsions. The only requirement is that the emulsifier be compatible with the other components and with the container that is employed for using the composition.

Emulsifiers of the nonionic type have been found to be particularly suitable in promoting the emulsification of white mineral oil and water. Emulsifiers which have been found especially suitable for the preparation of water-in-oil emulsions of white mineral oil and water to provide the compositions of the invention are sorbitan fatty acid esters e.g., sorbitan monopalmitate, sorbitan monolaurate, sorbitan monostearate, sorbitan monooleate, sorbitan tristearate, sorbitan trioleate, sorbitan sesquioleate; polyglycerol esters of fatty acids, e.g., polyglycerol monooleate and polyglycerol monostearate. The preferred water-in-oil emulsifiers are the fatty acid esters of anhydrosorbitol, polyglycerides of fatty acids, and mono-, di- and tri-ethanolamine stearates. These emulsifiers will have a low HLB (hydrophilic-lipophilic balance), e.g., 2–8, so as to provide a water-in-oil emulsion. Representative commercially available examples of such emulsifiers include sorbitan monooleate sold under the tradename "Span 80", sorbitan monostearate sold under the tradename "Span 60" and the like. Mixtures of these emulsifiers can also be utilized, if desired.

The emulsifiers which have been found particularly suitable for promoting emulsification of white mineral oil and water to provide an oil-in-water emulsification are those having a high HLB, e.g., 9–20, and include the ethoxylated fatty acid esters of anhydrosorbitol e.g., polyoxyethylene sorbitan monolaurate; polyoxyethylene sorbitan monopalmitate; polyoxyethylene sorbitan monostearate; polyoxyethylene sorbitan tristearate; polyoxyethylene sorbitan monooleate; polyoxyethylene sorbitan trioleate (10–30 mols ethylene oxide mol sorbitan), and fatty acid alkanol amides (e.g., that sold under the trade designation "Monamid 150-ADY"). Representative commercially available examples of ethoxylated sorbitan fatty acid emulsifiers include those sold under the trade designations "Tween 80", "Tween 60" and "Tween 40". A representative commercially available fatty acid alkanol amide emulsifier is that sold under the commercial designation "Monamid 150-ADY".

The quantity of emulsifier should be the minimum quantity consistent with the production of a water-in-oil or oil-in-water emulsion which is storage-stable over long periods of time and at temperatures which may fluctuate between 0° C. and 50° C. Typically, the amount of emulsifier will vary between 0.5% and 10% by weight, preferably 1% and 5% by weight of the total formulation, depending upon the amount of material to be emulsified. It is generally desirable to use the lowest effective quantity of emulsifier, since excessive emulsifier may produce cloudy or streaky films on the treated surface.

In the compositions of the present invention which are formulated for aerosol dispensing, a compatible aerosol propellant provides a means of expulsion of the composition from its container. The aerosol propellants useful in the practice of this invention are liquified and normally gaseous materials typically used for this purpose. Preferred propellants are hydrocarbon liquid normally gaseous propellants including propane, isopropane, butane, isobutane and mixtures thereof. Halogenated hydrocarbon propellants such as chlorodifluoromethane, dichlorotetrafluoroethane, dichlorodifluoromethane and the like can also be used but these may be undesirable for environmental reasons. The propellant should be present in a sufficient amount to expel the entire contents from the aerosol container. Typically the amount of propellant which has been found useful has been on the order from 5 to 25 parts propellant by weight of the entire container contents, preferably about 8 to about 15 parts by weight.

In some cases, the cleaning composition may cause container corrosion which could lead to leakage. This is a well known problem in the aerosol industry and has been corrected by the addition of a suitable amount of a compatible container corrosion inhibiting agent. Such inhibiting agents may be required in aerosol compositions according to the present invention. Suitable corrosion inhibiting agents include monoethanolamine, morpholine and sodium nitrite. Monoethanolamine is the preferred container corrosion inhibiting agent. The amount of container corrosion inhibiting agent will typically be on the order of 0.1% to 5% by weight of the entire contents of the container, preferably 0.1% to 2% by weight.

The composition of the invention may also include other compatible ingredients typically found in similar treating compositions. For example, the composition may contain colorants to provide a more aesthetic color, additional surfactant for cleaning, fragrances and the like to provide a more pleasant odor and disinfectant materials. Such additional ingredients will typically not exceed about 2% by weight of the entire composition.

The treating compositions of the invention may be conveniently produced by mixing the white mineral oil, water, fragrances and other ingredients together with sufficient agitation to result in the formation of an emulsion. Separately heating the water and oil may be required to facilitate the preparation of the emulsion. If the composition is to be dispensed from an aerosol container, the emulsion is first formed and then transferred into aerosol containers with a suitable quantity of propellant and sealed therein.

Treating compositions, prepared in accordance with the present invention, are illustrated by the following representative examples.

EXAMPLE 1

A water-in-oil aqueous emulsion of white mineral oil was prepared in accordance with the invention using the ingredients shown below. The oil and water were separately heated to 80° C., emulsification surfactant added to the oil with the vigorous stirring under a propeller blade mixer, and the heated water slowly added to the heated oil with continued vigorous stirring. The resultant emulsion was cooled and packaged in separate containers for use.

| Ingredients | % by Weight |
|---|---|
| "Carnation" white mineral oil having a Saybolt viscosity at 100° F. of 60–70 | 25.0 |
| Emulsification surfactant ("Span 80") HLB 4.3 | 1.0 |
| Monoethanolamine | 0.35 |
| Water | Balance to 100 |

EXAMPLE 2

An oil-in-water emulsion was prepared of the ingredients shown below by first separately heating the oil and water, adding the emulsification surfactant to the water with vigorous stirring as described in Example 1 and slowly adding the oil to the water with continued vigorous stirring to produce the emulsion.

| Oil in Water Ingredients | % by Weight |
|---|---|
| "Carnation" white mineral oil having a Saybolt viscosity at 100° F. of 60–70 | 25.0 |
| Emulsification surfactant ("Tween 81") HLB 10.0 | 1.0 |

-continued

| Oil in Water Ingredients | % by Weight |
|---|---|
| Monoethanolamine | 0.35 |
| Water | Balance to 100 |

EXAMPLE 3

A water-in-oil emulsion composition according to the invention was prepared of the following ingredients using the procedure of Example 1:

| Ingredients | % by Weight |
|---|---|
| "Carnation" white mineral oil having a Saybolt viscosity at 100° F. of 60–70 | 25.0 |
| Emulsification surfactant polyglycerol oleate ("Hodag PGO") | 1.0 |
| Monoethanolamine | 0.35 |
| Water | Balance to 100 |

EXAMPLE 4

An oil-in-water emulsion according to the invention was prepared of the ingredients shown below:

| Ingredients | % by Weight |
|---|---|
| "Carnation" white mineral oil having a Saybolt viscosity at 100° F. of 60–70 | 25.0 |
| Emulsification surfactant, mixed fatty acid alkanol amide ("Monamid 150-ADY") | 1.0 |
| Monoethanolamine | 0.35 |
| Water | Balance to 100 |

The emulsion was prepared according to the description of Example 1 starting initially as a water-in-oil emulsion and then inverting to an oil-in-water emulsion as all the ingredients are added.

EXAMPLE 5

| Ingredients | % by Weight |
|---|---|
| "Carnation" white mineral oil having a Saybolt viscosity at 100° F. of 60–70 | 25.0 |
| Emulsification surfactant ("Tween 80") HLB 15.0 | 0.1 |
| ("Span 80") HLB 4.3 | 0.9 |
| Monoethanolamine | 0.35 |
| Water | Balance to 100 |

EXAMPLE 6

An aerosol composition was prepared according to the invention by charging 90 parts of the composition according to Example 1 into an aerosol container with 10 parts isobutane and sealing the container with an appropriate valve fitted with an aerosol dispensing nozzle.

Each composition described above was employed to treat soiled stainless steel surfaces. Each performed exceptionally well, cleaning both oil-based soil and water-soluble soil from the surface of the stainless steel, leaving a light film of oil to protect the stainless steel. The result was a shiny, uniform non-oily appearing stainless steel surface. The compositions also performed exceptionally well, cleaning the surfaces of acrylic plastic articles, polycarbonate articles, plastic laminates such as those sold under the trade designation "Formica", painted and vinyl coated surfaces, etc.

What is claimed is:

1. Method of treating a stainless steel surface comprising applying upon said surface a treating composition consisting essentially of an aqueous storage-stable emulsion of white mineral oil containing from about 20 to about 50 parts by weight white mineral oil having a Saybolt viscosity at 100° F. in the range of about 50 to about 380 Saybolt seconds, sufficient nonionic emulsion surfactant to produce said emulsion yet not so much surfactant as to leave a visible residue of same on the treated surface, and the balance of 100 parts being water, rubbing said surface to dislodge soil and wiping said surface to remove excess treating composition and removed soil, leaving on the treated surface a clear nonevaporating, even, non-streaked, thin film of white mineral oil.

2. The method of claim 1 wherein said emulsion surfactant has an HLB of 2–8 and is selected from the group consisting of sorbitan fatty acid esters and polyglycerol esters of fatty acids and said emulsion is a water-in-oil emulsion.

3. The method of claim 1 wherein said emulsion surfactant has an HLB of 9–20 and is selected from the group consisting of ethoxylated fatty acid esters of anhydrosorbitol, polyglycerides of fatty acids and fatty acid alkanol amides and said emulsion is an oil-in-water emulsion.

4. The method of claim 1 wherein the quantity of said emulsion surfactant varies between about 0.5%–10% by weight of the total weight of said composition.

5. The method of claim 1 wherein said treating composition consists essentially of:

A. 85 to 92 parts by weight of an aqueous emulsion of white mineral oil consisting of
   (1) 20 to 50 parts by weight white mineral oil having a Saybolt viscosity at 100° F. between about 50–380 Saybolt seconds;
   (2) 0.5 to 10 parts by weight sorbitan monooleate emulsification surfactant;
   (3) 0.1 to 2 parts by weight anti-corrosion agent selected from the group consisting of morpholine, monoethanolamine and sodium nitrite;
   (4) the balance to 100 parts by weight water; and B. 8 to 15 parts by weight liquified and normally gaseous compatible aerosol propellant material, contained in a suitable sealed vessel fitted with dispensing means.

* * * * *